US011134731B2

(12) United States Patent
Hussey et al.

(10) Patent No.: US 11,134,731 B2
(45) Date of Patent: Oct. 5, 2021

(54) PROTECTIVE HOOD WITH IMPROVED VISION FOR WATERPROOF MARINE GARMENTS

(71) Applicant: Zhik Pty Ltd, Artarmon (AU)

(72) Inventors: Thomas Kenneth Hussey, Balmain (AU); Bartosz Milczarczyk, Umina Beach (AU)

(73) Assignee: Zhik Pty Ltd, Artarmon (AU)

( * ) Notice: Subject to any disclaimer, the term of this patent is extended or adjusted under 35 U.S.C. 154(b) by 0 days.

(21) Appl. No.: 15/923,440

(22) Filed: Mar. 16, 2018

(65) Prior Publication Data

US 2018/0271189 A1 Sep. 27, 2018

(30) Foreign Application Priority Data

Mar. 24, 2017 (AU) ..... 2017901058
Jul. 27, 2017 (AU) ..... 2017902958

(51) Int. Cl.

| | |
|---|---|
| ***A41D 13/11*** | (2006.01) |
| ***A41D 3/02*** | (2006.01) |
| ***A41D 13/012*** | (2006.01) |
| ***A41D 15/00*** | (2006.01) |
| ***A41D 3/04*** | (2006.01) |
| *A41D 27/18* | (2006.01) |

(52) U.S. Cl.

CPC ..... *A41D 13/1184* (2013.01); *A41D 3/02* (2013.01); *A41D 3/04* (2013.01); *A41D 13/012* (2013.01); *A41D 13/1161* (2013.01); *A41D 15/002* (2013.01); *A41D 27/18* (2013.01); *A41D 2200/20* (2013.01); *A41D 2400/70* (2013.01); *A41D 2600/10* (2013.01)

(58) Field of Classification Search

CPC ..... A41D 13/1184; A41D 3/02; A41D 3/04; A41D 13/012; A41D 13/1161; A41D 15/002; A41D 27/18

See application file for complete search history.

(56) References Cited

U.S. PATENT DOCUMENTS

| | | | | |
|---|---|---|---|---|
| 1,097,530 A * | 5/1914 | Cabelinsky | 2/10 | |
| 1,482,270 A * | 1/1924 | Shuster | A42B 1/046 | 2/205 |
| 1,921,646 A * | 8/1933 | Yeaton | A41D 3/04 | 2/87 |
| 2,321,116 A * | 6/1943 | Welch | A41D 3/04 | 2/87 |
| 2,462,258 A * | 2/1949 | Dannenberg | A42B 1/062 | 2/10 |
| 2,500,982 A * | 3/1950 | Fligel | 2/84 | |

(Continued)

FOREIGN PATENT DOCUMENTS

DE 202006004497 U1 5/2006

OTHER PUBLICATIONS

Canadian Office Action Application No. 2,999,081 Completed: Dec. 11,2018 4 pages.

*Primary Examiner* — Richale L Quinn
(74) *Attorney, Agent, or Firm* — Nixon & Vanderhye P.C.

(57) ABSTRACT

A garment having a protective hood joined to a collar at an attachment point above a neck seam on the collar, the protective hood having a perimeter defining a hood opening, a rigid, transparent visor attached to the protective hood at the perimeter such that the visor is configured to cover eyes during normal wear.

20 Claims, 7 Drawing Sheets

(56) References Cited

U.S. PATENT DOCUMENTS 2,567,192 A * 9/1951 De Grazia ..... A42B 1/046 2/205
2,574,716 A * 11/1951 Spatz ..... A41D 3/00 2/84
2,581,366 A * 1/1952 De Grazia ..... A42B 1/045 2/203
2,882,894 A * 4/1959 Fahey ..... A62B 17/04 128/201.23
3,016,545 A * 1/1962 Donahue ..... A42B 1/062 2/195.5
3,243,823 A * 4/1966 Jenison ..... A41D 3/04 2/87
3,307,201 A * 3/1967 Pearson ..... A41D 3/04 2/87
4,821,341 A * 4/1989 Baptiste ..... A42B 1/062 2/10
5,369,809 A * 12/1994 Hall ..... A41D 3/00 2/202
5,491,841 A * 2/1996 Valletta ..... A42B 1/247 2/10
5,577,271 A * 11/1996 Davis ..... A01K 55/00 2/10
6,263,509 B1 * 7/2001 Bowen ..... A41D 13/05 2/108
6,374,418 B1 * 4/2002 Rindle ..... A42B 1/048 2/202
6,397,395 B1 * 6/2002 DeHart ..... A41D 3/005 2/173
6,654,963 B2 * 12/2003 Fayle ..... A41D 3/00 2/84
7,185,371 B2 * 3/2007 Koo ..... A42B 1/062 2/10
7,779,485 B2 * 8/2010 Gandy ..... A41D 3/00 2/202
8,037,547 B2 * 10/2011 Duncan ..... A62B 17/04 2/202
8,074,300 B1 * 12/2011 Molina ..... A42B 1/08 2/202
8,438,665 B2 * 5/2013 Roemer ..... A41D 3/00 2/84
8,806,664 B1 * 8/2014 Judge ..... A42B 3/105 2/84
9,155,922 B2 * 10/2015 Samaniego ..... A42B 1/048
9,320,310 B1 * 4/2016 Judge ..... A42B 3/105
9,380,822 B2 * 7/2016 Foster ..... A42B 1/18
9,486,020 B2 * 11/2016 Arora ..... A41D 13/0125
9,554,601 B2 * 1/2017 Arajakis ..... A41D 3/005
10,070,674 B1 * 9/2018 Beckers ..... A41D 3/00
10,244,804 B2 * 4/2019 Hodgson ..... A41D 3/04
10,299,526 B2 * 5/2019 DuCasse ..... A42B 1/067
2003/0131401 A1 * 7/2003 Dilworth, Jr. ..... A41D 13/12 2/457
2005/0108804 A1 * 5/2005 Bush ..... A41D 3/00 2/84
2005/0132461 A1 * 6/2005 Koo ..... A42B 1/247 2/12
2010/0011480 A1 * 1/2010 Carter ..... A41D 1/06 2/84
2010/0242149 A1 * 9/2010 Mickle ..... A41D 3/04 2/82
2011/0093998 A1 * 4/2011 Brennan ..... A41D 13/001 2/4
2013/0019378 A1 * 1/2013 White ..... B62J 9/006 2/84
2014/0317829 A1 * 10/2014 Rolfe ..... A41D 3/00 2/84
2015/0052661 A1 * 2/2015 Poznick ..... A42B 1/048 2/202
2015/0250240 A1 * 9/2015 Hunkele ..... A41D 3/04 2/86
2018/0042324 A1 * 2/2018 King ..... A42B 1/062
2018/0092410 A1 * 4/2018 Rundle ..... A41D 3/08
2018/0103707 A1 * 4/2018 Seu ..... A42B 1/064

* cited by examiner

PROTECTIVE HOOD WITH IMPROVED VISION FOR WATERPROOF MARINE GARMENTS

TECHNICAL FIELD

This invention relates to a protective hood on waterproof garments designed for sailing or other marine activities that provides improved vision to the user.

BACKGROUND

Waterproof garments used for sailing and other marine activities are commonly known in the art. These garments provide critical weather protection to sailors in rough seas and/or weather conditions.

The garments are commonly made from waterproof laminated or coated composite textiles joined by stitching and/or gluing, the seams are commonly made watertight by the application of hot-melt adhesive tape.

A typical collar and hood used on garments designed for offshore sailing is shown in FIGS. 1A and 1B. The garments generally feature a large collar 1 that protrudes from the neck line 16 of the garment to above the user's ears and a hood 10 that can be deployed to provide additional protection. Hoods designed for marine environments are generally configured to have a small rigid visor 11 that protrudes from the center top of the hood to provide additional protection from wind and water to the face. The hoods also generally feature a cord adjustment system 12 around the opening of the hood that allows the user to cinch the hood tightly over the head to secure it in place and a second cord adjustment system 13 that allows the length of the hood to be adjusted so that the visor can be positioned above the eye line.

It is known in the art to provide transparent windows 14 on the side of the hood as show in FIGS. 1A and 1B. These windows allow greater hood coverage over the face and therefore greater protection from wind and water whilst maintaining some vision through the hood. These transparent windows are made from a soft, flexible and transparent material such as Polyurethane sheet. The transparent material is selected to be flexible to allow for hood opening to be adjusted in size via means of the cord adjuster as well as to allow the hood to be rolled or folded away in a storage pouch 15 on the collar as shown in FIGS. 10 and 1D.

The size, shape and position of hoods and collars known in the art are a compromise between allowing sufficient protection while also allowing good visibility.

The visors 11 commonly used in the art are generally small so that they can be stowed in the storage pouches 15 which reduced their effectiveness, in addition the non-transparent nature of the visors means that they must be positioned above the eye-line to allow for visibility which also limits the protection that they can provide. Whilst the transparent windows known in the art provide some level of protection at the sides of the hood opening, the highly flexible nature of the windows means that often develop permanent marks from folding which quickly reduce the transparency of the material.

It is desirable to provide a hood system for waterproof garments that provides greater weather protection whilst also providing high levels of visibility to the user.

SUMMARY

The present invention discloses a protective hood and collar system for garments designed for offshore sailing and other marine activities that provides improved water and wind protection to the user whilst maintaining high levels of visibility.

The protective hood comprises a rigid visor made from a transparent material that protrudes from the front hood opening around the sides and top of the user's face. The hood can be tightened around the user's head so that the rigid visor substantially covers the user's face wherein the transparency of the material allows good vision through the visor. The rigid visor material is selected so that it is flexible enough to form a curve profile around to head yet have enough rigidity to prevent waves or splashes of water to collapse or compress the visor into the user's face.

In a preferred embodiment of the present invention, a means of tightening the hood around the users head is provided by a cord adjustment system around the hood opening. In a preferred embodiment, there is provided an area of the hood opening without the rigid visor so that the hood opening circumference can be reduced using said cord adjuster. In another preferred embodiment a second cord adjuster is provided to allow the length of the hood to be reduced thereby controlling the position of the visor over the face.

In another preferred embodiment of the present invention, the hood is configured to be stowed over the collar at the back of the user's head when not in use. This stowage position allows easy access to stow or deploy the hood whilst sailing and forgoes the need to provide a storage pouch that the hood is rolled and/or folded into. The elimination of the storage pouch is preferable for the use of the large rigid visor which is not required to be folded or rolled into a compact space. In an important aspect of this embodiment, the hood can be positioned so that it fits behind the head snugly so that it is unaffected by high wind and is not easily caught when maneuvering around the sailing vessel.

In a preferred embodiment of the present invention the transparent rigid visor is configured to be detachable from hood via a means of a fastening system. The fastening system allows the user to remove the rigid visor when not required. The fastening system may be comprised of various fastening means such as press studs or buttons, zippers, hook and loop fasteners or other means as known in the art. The system allows the visor to be easily replaced by the user if damaged and also allows different rigid visors with different functional or aesthetic properties to be interchanged based on conditions or user preference.

In an alternative embodiment of the present invention, the rigid visor may be fixed to hood 10 at hood opening 23 by a stitching means can be easily unpicked to allow for easy replacement or removal of the visor. In another embodiment of the present invention, the rigid visor may be folded inwards and positioned on the underside of hood when not desired by the user.

DETAILED DESCRIPTION

Figure 1A:
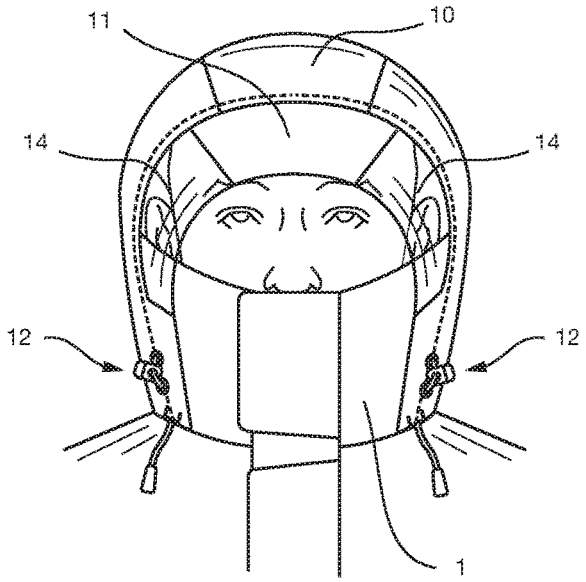
FIG. 1A PRIOR ART
FIGS. 1A & 1B are a front view and side view of an example of a hood and collar system commonly known in the art.
Figure 1B:
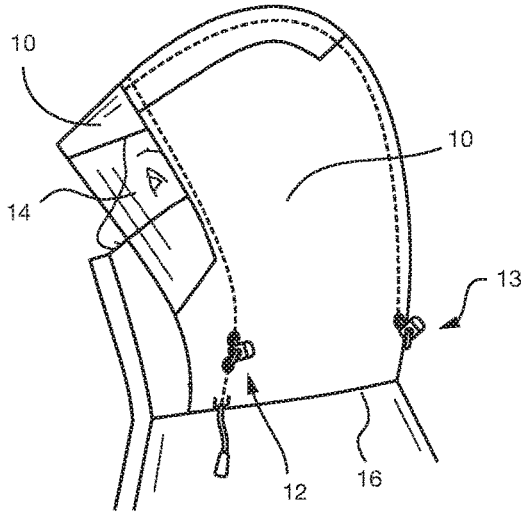
FIG. 1B PRIOR ART
Figure 1C:
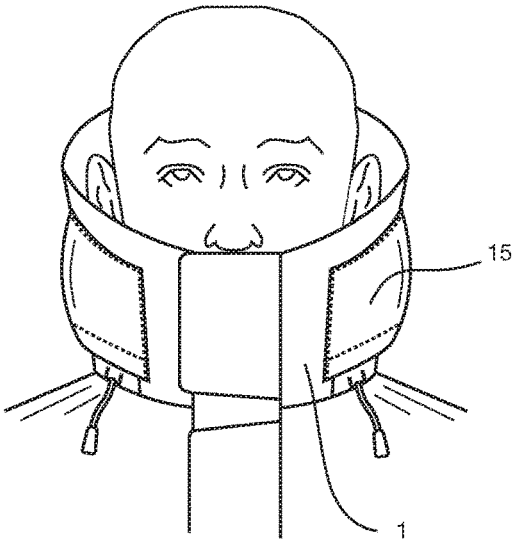
FIG. 1C PRIOR ART
FIGS. 1C & 1D are a front view and side view of the example of a hood and collar system commonly known in the art shown in FIGS. 1A and 1B with hood stowed in a storage pouch.
Figure 1D:
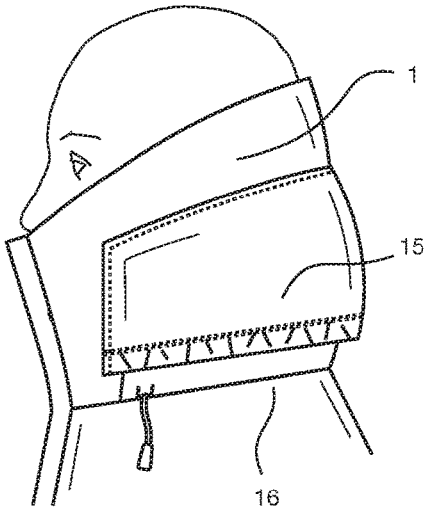
FIG. 1D PRIOR ART
Figure 2A:
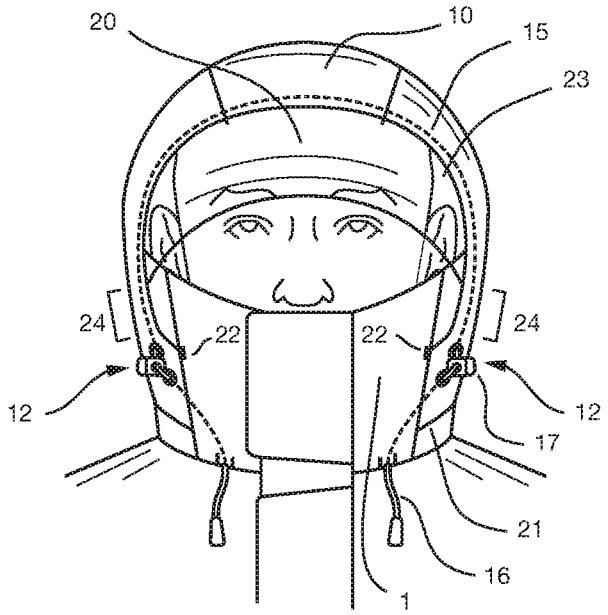
FIGS. 2A & 2B are a front view and side view of the hood and collar of the present invention with hood deployed.
Figure 2B:
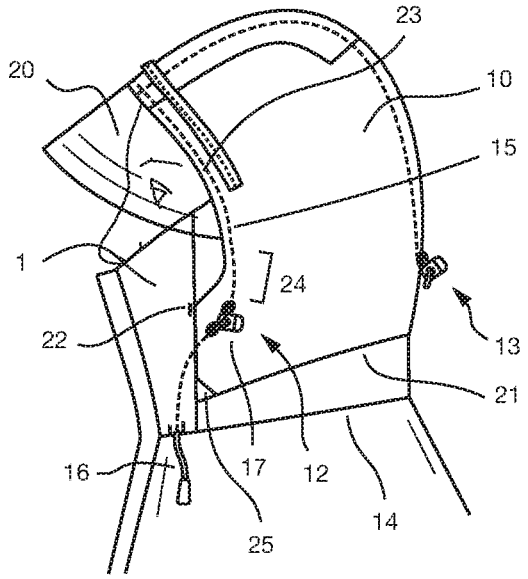

FIGS. 2A and 2B show a front and side view of a preferred embodiment of the present invention. A protective hood 10 is attached to collar 1 at a hood base seam 21. A front hood opening 23 is provided and is fixed to the collar at points 22. A rigid visor 20 made from a transparent material protrudes from the hood opening 23 around the sides and top of the users face.

The hood 10 is made from a substantially waterproof and preferably breathable textile as known in the art. The rigid visor 20 is preferably made from a transparent polycarbonate sheet or other similar material. The thickness of the material is preferably between 0.1 mm-0.8 mm or in some embodiments between 0.8 mm and 2 mm and is selected to have enough flexibility to bend around the head from one side of the face to the other in a single plane yet have enough rigidity in the opposite plane to prevent waves or splashes of water to collapse or compress the visor into the users face. In an embodiment, the edge of the rigid visor that is not attached to the hood has a textile binding attached to edge or other means to reduce the sharpness of the edge to prevent the edge from cutting the user during use. In another embodiment, the visor is molded into the curved shape by a thermo molding, vacuum forming, injection molding or other process known in the art and is optionally rigid in both planes. In a preferred embodiment, said visor material comprises anti-fog coating or treatment and/or water repellent treatment and/or anti-scratch treatment to maintain optimal visibility.

An adjustment means 12 is provided around the hood opening to allow the opening circumference to be reduced thereby tightening the hood around the users head. Flexible areas 24 are provided between the rigid visor 20 and attachment point 22, this area can be compressed to reduce the hood opening circumference. The flexible areas 24 are necessary to allow the tightening of the hood as the rigid visor 20 does not allow any reduction in the circumference of the hood opening where it is joined.

The adjustment means is preferably provided by an elastic or non-elastic cord 16 that runs around the hood opening through a tunnel 15. The tunnel 15 is preferably positioned on the inside of the hood nearby the join between hood opening 23 and rigid visor 20. A cord lock 17 is positioned nearby the attachment point 22 to allow the cord 16 to be tensioned.

Figure 2C:
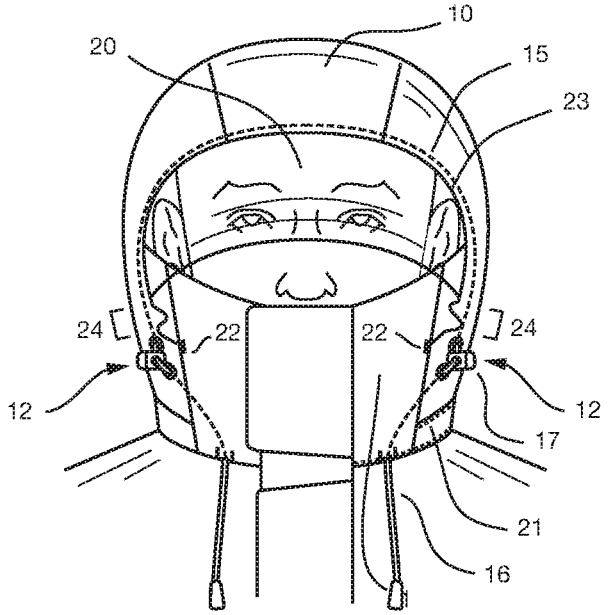
FIGS. 2C & 2D are a front view and side view of the hood and collar of the present invention with hood tightened around the users head.
Figure 2D:
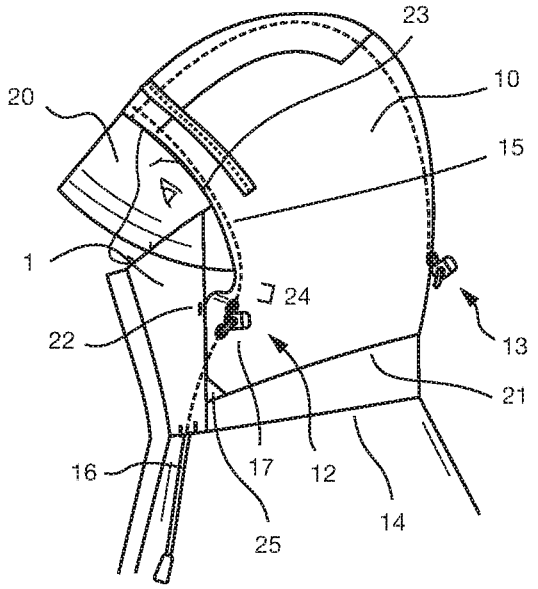

By tightening the hood around the user's head, the transparent rigid visor 20 is positioned over the user's face as shown in FIGS. 2C and 2D thereby providing optimum protection from wind and water. The transparency of the visor 20 allows it to be positioned over the user's line of sight without severely compromising vision.

In a preferred embodiment, a second adjustment means 13 is provided that reduces the hood length between the center lower back of the hood and center top of the hood opening. This adjustment means allows the hood length to be reduced to optimize the position of the visor 20 over the face.

The circumference of the hood opening 23 is sized to provide sufficient hood height to fit over the user's head and also to accommodate the fitment over any headwear articles worn by the user such as beanies or helmets. The hood opening is joined to the collar at attachment points 22.

Figure 2E:
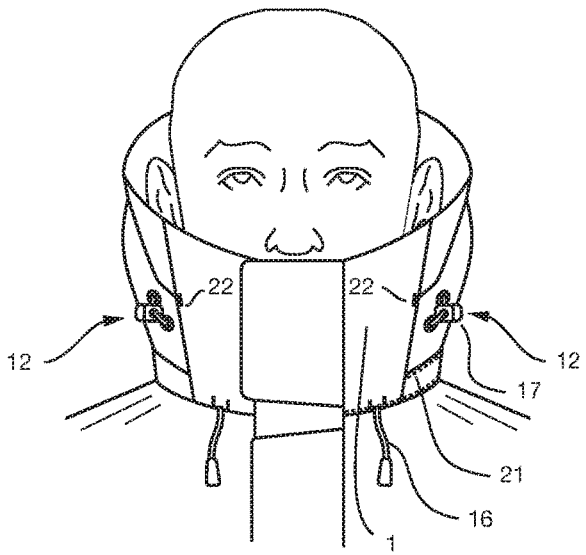
FIGS. 2E & 2F are a front view and side view of the hood and collar of the present invention with hood stowed.
Figure 2F:
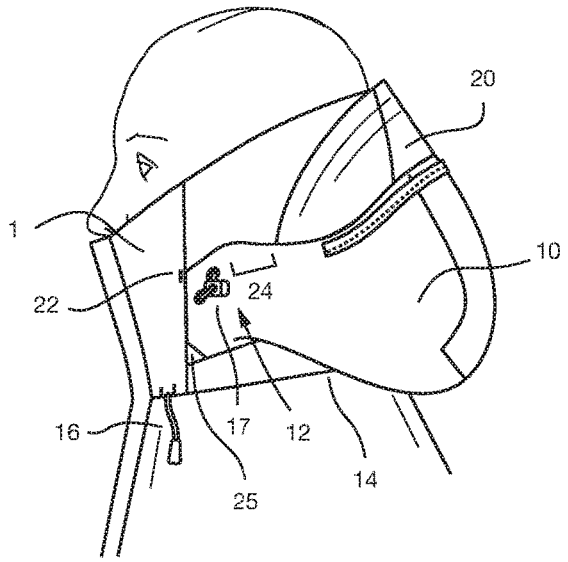

The attachment points 22 are positioned on the collar 1 to allow the hood 10 to be stowed snugly around the collar at the back of the user's head when not in use as shown in FIGS. 2E and 2F. This stowage position forgoes the need to provide a storage pouch which is preferable for the use of the large rigid visor which is not required to be folded or rolled into a compact space. The stowage position also allows the sailor to deploy and stow the hood with a single one-handed motion whilst sailing The hood opening attachment points 22 are preferably positioned above the neck seam 14 to allow a reduction in hood opening circumference whilst maintaining the required hood height. This allows the hood opening circumference to be configured to be slightly larger than the circumference around the back of the neck between the points 22. In a preferred embodiment the hood opening adjustment means 12 can be tightened when the hood is in the stowed position to allow it to sit tightly around the back of the head.

The above configuration of the hood opening circumference is important so that the hood fits snugly behind the head when stowed. This allows the stowed hood to be unaffected by high wind and not easily caught when maneuvering around the sailing vessel.

The hood seam 21 where the base of the hood is attached to the collar can be in-line with the opening fixing points 22 or optionally below these points between neck seam 14 and points 22. In a preferred embodiment, drain holes 25 are provided to allow water that gathers between the hood 10 and collar 1 to escape.

Figure 3A:
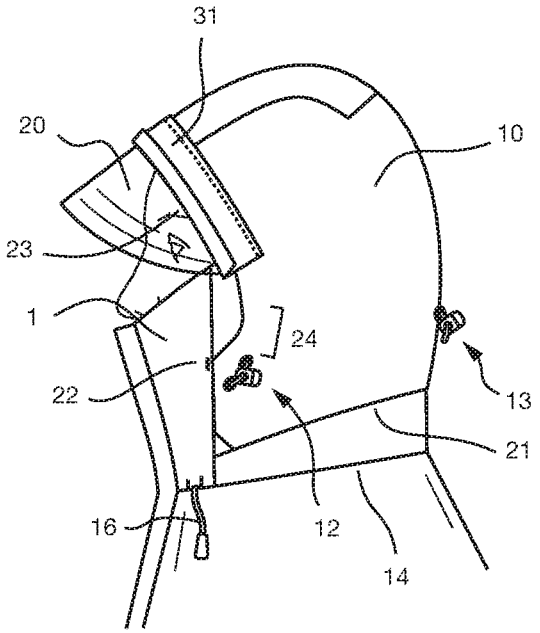
FIGS. 3A & 3B are side views of an embodiment of the present invention. The visor is removed in FIG. 3B.
Figure 3B:
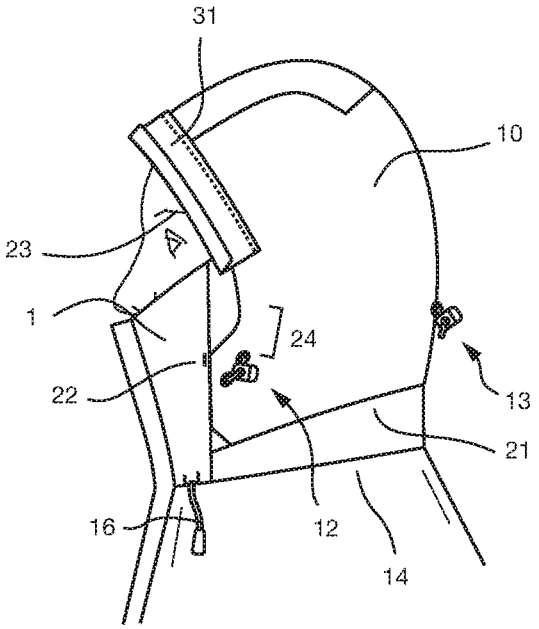

In another preferred embodiment of the present invention as shown in FIGS. 3A and 3B, said transparent rigid visor 20 is configured to be detachable from hood 10 via a means of a fastening system 30 at hood opening 23. The fastening system allows the user to remove the rigid visor 20 when not required as shown in FIG. 3B. The fastening system may be comprised of various fastening means such as press studs or buttons, zippers, hook and loop fasteners or other means as known in the art. The system allows the visor to be easily replaced by the user if damaged and also allows different rigid visors with different functional or aesthetic properties to be interchanged based on conditions or user preference.

The functional aesthetic properties may include but are not limited to different stiffness or thickness of the visor material, different size and shape of visor, different optical properties of the visor material as well as different colour or tints of the visor material. In some preferred embodiments the visors may feature a coating to reduce transmission of UV or visible light to protect the user. In other embodiments the visor may feature a coating that improves visibility in low light conditions.

In a preferred embodiment, a gutter 31 is provided that is attached to hood 10 parallel to hood opening 23 and covers the fastening system 30 to prevent water intrusion between the visor and hood opening. The gutter 31 is preferably comprised of a waterproof textile of same or similar construction to the hood and is stitched or bonded to the hood and sealed to prevent water intrusion at the seam. The gutter 31 is preferably configured to be folded backwards as shown in FIGS. 4A, 4B, 5A, 5B, 6A and 6B exposing the fastening system 30 to allow for easy attachment and detachment of the visor.

Figure 4A:
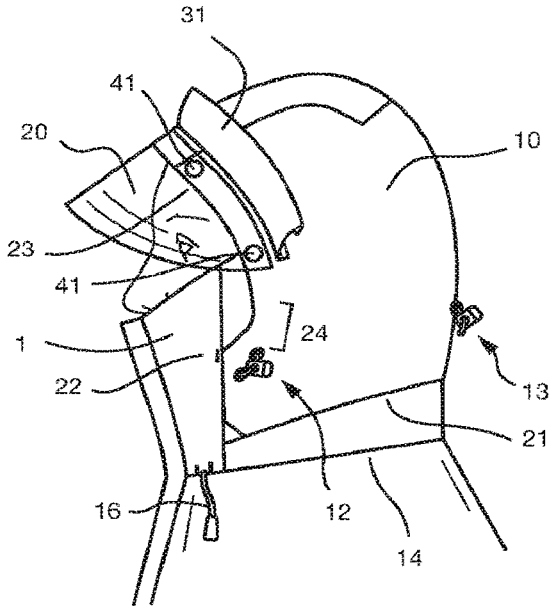
FIGS. 4A & 4B are side views of an embodiment of the present invention. The visor is removed in FIG. 4B.
Figure 4B:
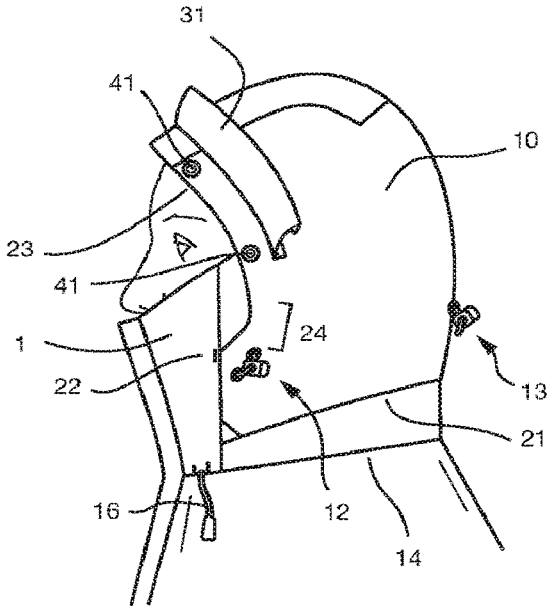
Figure 4C:
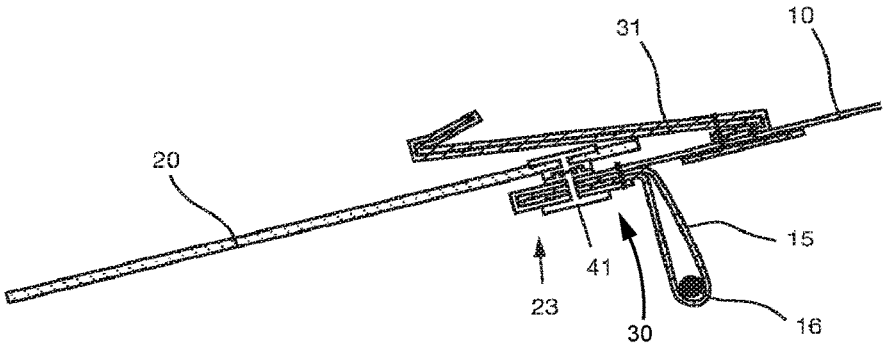
FIG. 4C is a cross sectional detail view of the visor attachment system of an embodiment of the present invention shown in FIGS. 4A and 4B.

One embodiment of said fastening system 30 is shown in FIGS. 4A, 4B and 4C, whereby a series of press studs or buttons 41 are provided along hood opening 23 and adjacent edge of the rigid visor 20. The gutter 31 is preferably provided to prevent water ingress between visor 20 and hood opening 23 and is attached to the hood 10 parallel to hood opening 23, and covers the fastening system 30 as shown in cross section view in FIG. 4C.

Figure 5A:
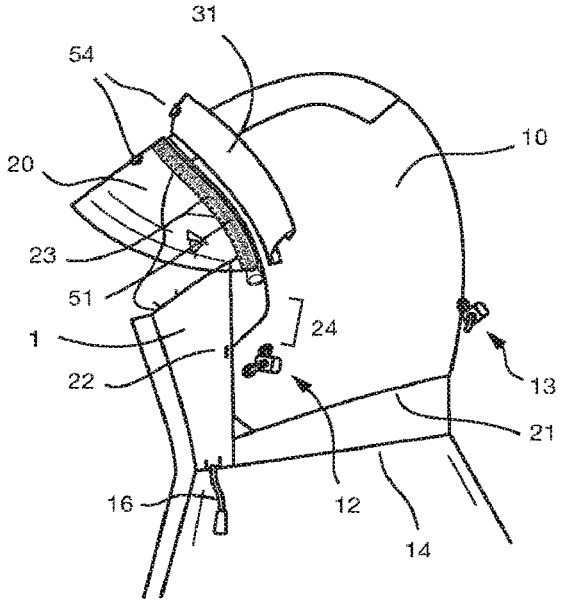
FIGS. 5A & 5B are side views of an embodiment of the present invention. The visor is removed in FIG. 5B.
Figure 5B:
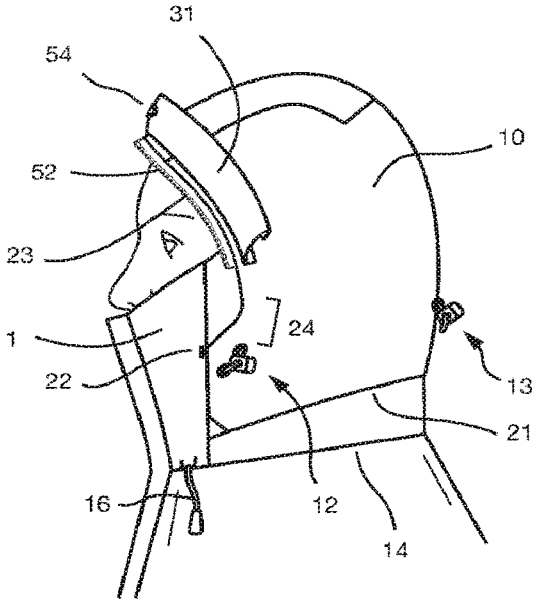
Figure 5C:
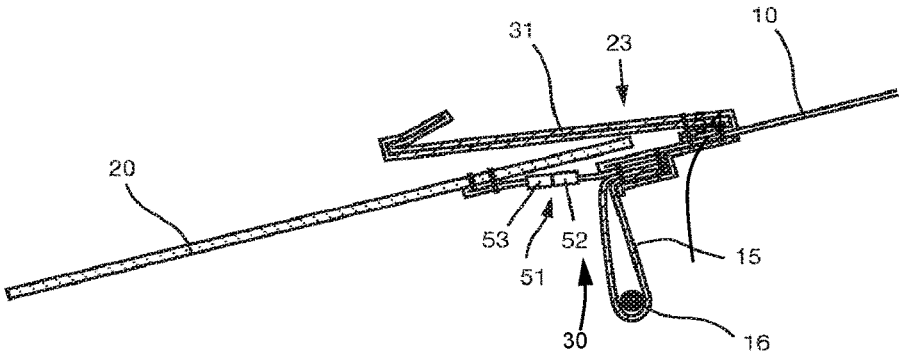
FIG. 5C is a cross sectional detail view of the visor attachment system of an embodiment of the present invention shown in FIGS. 5A and 4B.

A second potential embodiment of the fastening system 30 is shown in FIGS. 5A, 5B and 5C, whereby a zipper 51 is provided with first element 52 fixed along hood opening 23 and second element 53 fixed along the adjacent edge of the visor 20. The gutter 31 is preferably provided to prevent water ingress between visor 20 and hood opening 23. In a preferred embodiment, a fastening means 54 may be provided to secure the gutter 31 to the visor 20 to prevent the gutter folding back during use. The fastening means is preferably provided by a press stud, button or hook and loop fastener or other method known in the art. In a preferred embodiment shown in FIG. 5C, rigid visor 20 extends over zipper 51 to increase the rigidity of the attachment between visor 20 and hood opening 23.

Figure 6A:
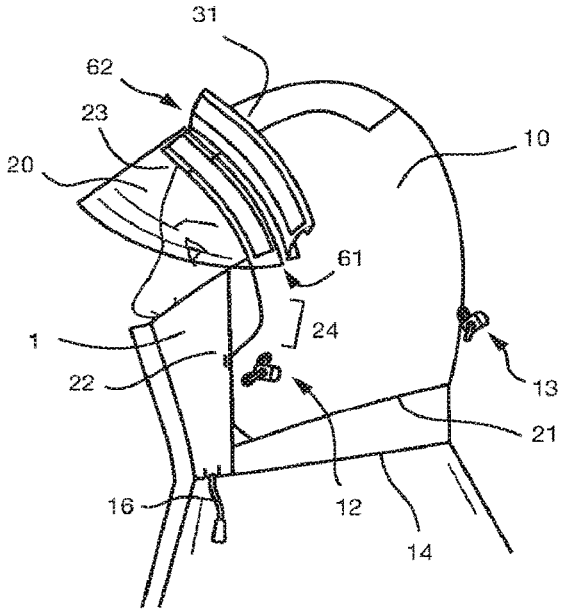
FIGS. 6A & 6B are side views of an embodiment of the present invention. The visor is removed in FIG. 6B.
Figure 6B:
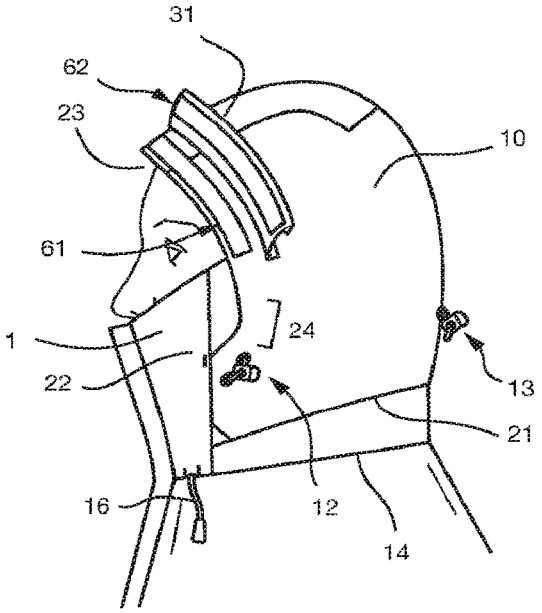
Figure 6C:
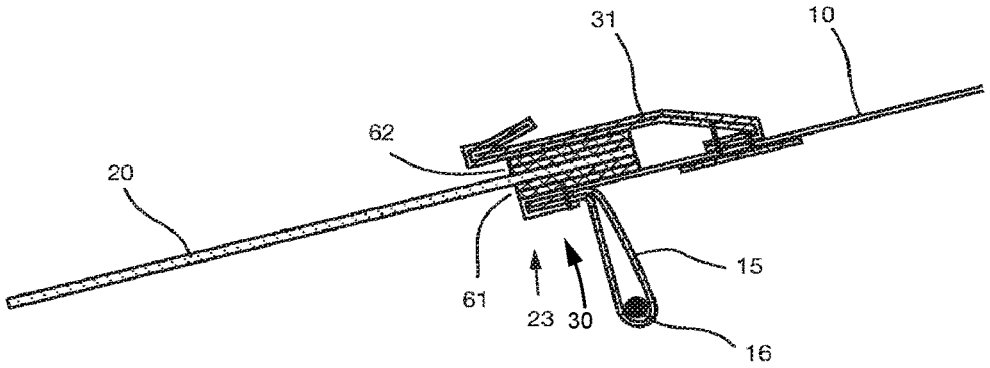
FIG. 6C is a cross sectional detail view of the visor attachment system of an embodiment of the present invention shown in FIGS. 6A and 6B.

A third potential embodiment of said fastening system 30 is shown in FIGS. 6A, 6B and 6C, whereby a first set of hook and loop fasteners 61 is provided on the underside of visor 20 and top of hood opening 23 and optionally a second set of hook and loop fasteners 62 are provided on top of visor 20 and on the underside of gutter 31 for additional security and rigidity.

In an alternative embodiment of the present invention, said rigid visor may be fixed to hood 10 at hood opening 23 by a stitching means that is exposed underneath gutter 31 wherein said stitch can be easily unpicked to allow for easy replacement or removal of the visor. In another embodiment of the present invention, said rigid visor 20 may be folded inwards and positioned on the underside of hood 10 when not desired by the user.

While several embodiments have been disclosed, it will be apparent to those of ordinary skill in the art that aspects of the present invention include many more embodiments and implementations. Accordingly, aspects of the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A garment, comprising:

a protective hood joined to a collar at an attachment point above a neck seam on the collar;

the protective hood having a perimeter defining a hood opening;

a rigid, transparent visor attached to the protective hood at the perimeter such that the visor is configured to be positioned over but spaced away from the face of a user when worn in a deployed in-use position;

wherein the hood comprises a tunnel extending along the perimeter of the hood through which a cord is provided;

wherein the hood is configured to be movable between the deployed position and a stowed position in which the hood and visor are stowed along a rear, outside surface of the collar;

a transparent portion of the visor is directly attached to the hood along a top part of the perimeter of the hood opening;

the tunnel extends from a first lateral end of the visor to a second lateral end of the visor, parallel to the top part of the perimeter, and the cord is positioned to be tightened when the hood and visor are in the stowed position to allow the hood and the visor to sit tightly around the back of the user's head.

2. The garment of claim 1, wherein the cord has a cord lock.

3. The garment of claim 1, the hood having a further tunnel extending between a center lower back area of the hood and a center top area of the hood opening, through which a further cord is provided.

4. The garment of claim 1, wherein drain holes are provided on the hood.

5. The garment of claim 1, wherein the visor has a functional coating or treatment selected from at least one of: anti-fog, water repellent, anti-scratch, light reduction, or low light visibility.

6. The garment of claim 1, wherein the visor is formed by thermo molding, vacuum forming, and/or injection molding.

7. The garment of claim 1, wherein the visor is attachable and detachable from the hood.

8. The garment of claim 7, wherein the visor has a first fastener, and the hood has a second fastener engageable with the first fastener.

9. The garment of claim 8, the first fastener is a press stud or button, a zipper, or a hook and loop fastener.

10. The garment of claim 1, wherein a gutter is provided on the hood above the perimeter, and the gutter is at least partially removable from the hood.

11. The garment of claim 1, wherein the visor is a first visor, and the system further includes a second visor different from the first visor that is attachable to the hood when the first visor is detached from the hood.

12. The garment of claim 1, the visor having an arcuate top edge and an arcuate bottom edge, the distance between the top edge and the bottom edge is configured so that the visor extends from a forehead to over the eyes during normal wear.

13. The garment of claim 12, wherein the top edge and the bottom edge meet at a left side of the visor to define a first vertex, and the top edge and the bottom edge of the visor meet at a right side of the visor to define a second vertex.

14. The garment of claim 1, wherein the visor is configured to project from approximately the top of the forehead to a position forward of the user's nose.

15. The garment of claim 1, wherein the visor is dimensioned to be spaced from and cross the bridge of the user's nose, such that the user's line of sight is through the transparent visor.

16. The garment of claim 1, wherein the cord is configured to be tightened when the hood is in the stowed position, to secure the hood in the stowed position.

17. The garment of claim 1, wherein in the stowed position, the visor is positioned above the attachment point, and wherein the visor has a curved shape that is adapted to cover the rear, outside surface of the collar and a rear part of the user's head in the stowed position.

18. The garment of claim 1, wherein the hood and visor are configured to be moved from the deployed position to the stowed position with a single one-handed motion.

19. The garment of claim 1, wherein the transparent portion of the visor has an upper end and a lower end, the upper end being attached to the hood along a top part of the perimeter of the hood opening, and the lower end forming a free end that is not supported.

20. The garment of claim 1, wherein, in the stowed position, the visor is not rolled and is not folded, and wherein the transparent portion of the visor is securely positioned in the stowed position to extend above the hood.

* * * * *